US011253116B2

(12) United States Patent
Hand et al.

(10) Patent No.: US 11,253,116 B2
(45) Date of Patent: Feb. 22, 2022

(54) COMFORT TOILET SEAT

(71) Applicant: Bemis Manufacturing Company, Sheboygan Falls, WI (US)

(72) Inventors: Joseph M. Hand, Sheboygan Falls, WI (US); Brian A. Henne, Elkhart Lake, WI (US); Brian LeMahieu, Sheboygan, WI (US); Roy Spatz, Elkhart Lake, WI (US)

(73) Assignee: BEMIS MANUFACTURING COMPANY, Sheboygan Falls, WI (US)

( * ) Notice: Subject to any disclaimer, the term of this patent is extended or adjusted under 35 U.S.C. 154(b) by 43 days.

(21) Appl. No.: 16/853,206

(22) Filed: Apr. 20, 2020

(65) Prior Publication Data

US 2020/0375416 A1 Dec. 3, 2020

Related U.S. Application Data

(60) Provisional application No. 62/854,662, filed on May 30, 2019.

(51) Int. Cl.
*A47K 13/24* (2006.01)

(52) U.S. Cl.
CPC ..... *A47K 13/24* (2013.01)

(58) Field of Classification Search
CPC ..... A47K 13/24; A47K 13/00; A47K 13/02
USPC ..... 4/237, 234
See application file for complete search history.

(56) References Cited

U.S. PATENT DOCUMENTS 1,954,448 A * 4/1934 Hackett ..... A47K 13/00 40/299.01
2,899,689 A 8/1959 Pastl
3,845,183 A 10/1974 Harrison
4,155,127 A 5/1979 Seiderman
4,189,794 A * 2/1980 Aleman-Mucino .... A47K 13/02 4/237
4,391,001 A 7/1983 Harrison
(Continued)

FOREIGN PATENT DOCUMENTS

CN 2456622 Y 10/2001
CN 109758018 A 5/2019
(Continued)

OTHER PUBLICATIONS

The Toilet Zone, "Best Padded Toilet Seats 2019 / 7 Soft Seats Worth Your Hard-Earned Money," <https://thetoiletzone.com/best-cushioned-toilet-seats/> publicly available as early as May 7, 2019.
(Continued)

*Primary Examiner* — Huyen D Le
(74) *Attorney, Agent, or Firm* — Michael Best & Friedrich LLP

(57) ABSTRACT

A toilet seat includes a toilet seat frame having a first support surface and an edge defining an aperture extending through the toilet seat frame. The first support surface is configured to at least partially support a user on the toilet seat. The toilet seat also includes a flexible support member having an outer rim coupled to the edge of the toilet seat frame such that the flexible support member is suspended across the aperture of the toilet seat frame. The flexible support member includes a second support surface configured to at least partially support the user on the toilet seat.

20 Claims, 7 Drawing Sheets

(56) References Cited

U.S. PATENT DOCUMENTS

| | | | | |
|---|---|---|---|---|
| 5,458,089 | A | 10/1995 | Rymer | |
| 6,370,704 | B1 | 4/2002 | White, Jr. | |
| 8,112,825 | B2 * | 2/2012 | Li | A47K 13/24 4/237 |
| 8,312,571 | B2 * | 11/2012 | Vierkant, III | A47K 13/02 4/237 |
| 9,339,157 | B2 | 5/2016 | Sarkar | |
| 9,756,995 | B2 | 9/2017 | Bryant | |
| 2003/0024036 | A1 * | 2/2003 | Toldo | B29C 45/6714 4/237 |
| 2004/0064876 | A1 | 4/2004 | Lu | |
| 2009/0126090 | A1 | 5/2009 | Chen | |

FOREIGN PATENT DOCUMENTS

| | | | |
|---|---|---|---|
| DE | 202014003179 | U1 | 4/2014 |
| JP | 2013153841 | A | 8/2013 |
| KR | 20150003485 | U | 9/2015 |
| TW | 200836687 | A | 9/2008 |

OTHER PUBLICATIONS

Extended European Search Report issued by the European Patent Office for Application No. 20172734.4 dated Oct. 8, 2020 (8 pages).

* cited by examiner

COMFORT TOILET SEAT

CROSS-REFERENCE TO RELATED APPLICATION

This application claims priority to U.S. Provisional Patent Application No. 62/854,662 filed May 30, 2019, the entire contents of which are incorporated herein by reference.

FIELD OF THE DISCLOSURE

The present disclosure relates to toilet seats, and more particularly to comfort toilet seats.

SUMMARY

In one aspect, a toilet seat includes a toilet seat frame having a first support surface and an edge defining an aperture extending through the toilet seat frame. The first support surface is configured to at least partially support a user on the toilet seat. The toilet seat also includes a flexible support member having an outer rim coupled to the edge of the toilet seat frame such that the flexible support member is suspended across the aperture of the toilet seat frame. The flexible support member includes a second support surface configured to at least partially support the user on the toilet seat.

In another aspect, a method of manufacturing a toilet seat includes forming a toilet seat frame including a first support surface and an aperture extending through the first support surface. The first support surface is configured to at least partially support a user on the toilet seat. The method also includes coupling an outer rim of a flexible support member to an edge of the toilet seat frame defining the aperture such that the flexible support member is suspended across the aperture of the toilet seat frame. The flexible support member includes a second support surface configured to at least partially support the user on the toilet seat.

In yet another aspect, a toilet seat includes a toilet seat frame having a first support surface, an aperture extending through the toilet seat frame, and a flange positioned within the aperture. The first support surface is configured to at least partially support a user on the toilet seat. The toilet seat also includes a flexible support member coupled to the flange and extending across the aperture. The flexible support member includes a second support surface configured to at least partially support the user on the toilet seat. The flexible support member is configured such that when a force is applied to the second support surface, a portion of the second support surface moves below a line that extends through opposing points on an upper edge of the flange.

In addition, other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and being practiced or being carried out in various ways. Also, it is to be understood that the phraseology and terminology used herein is for the purpose of description and should not be regarded as limiting. Terms of degree, such as "substantially," "about," "approximately," etc. are understood by those of ordinary skill to refer to reasonable ranges outside of the given value, for example, general tolerances associated with manufacturing, assembly, and use of the described embodiments.

Figure 1:
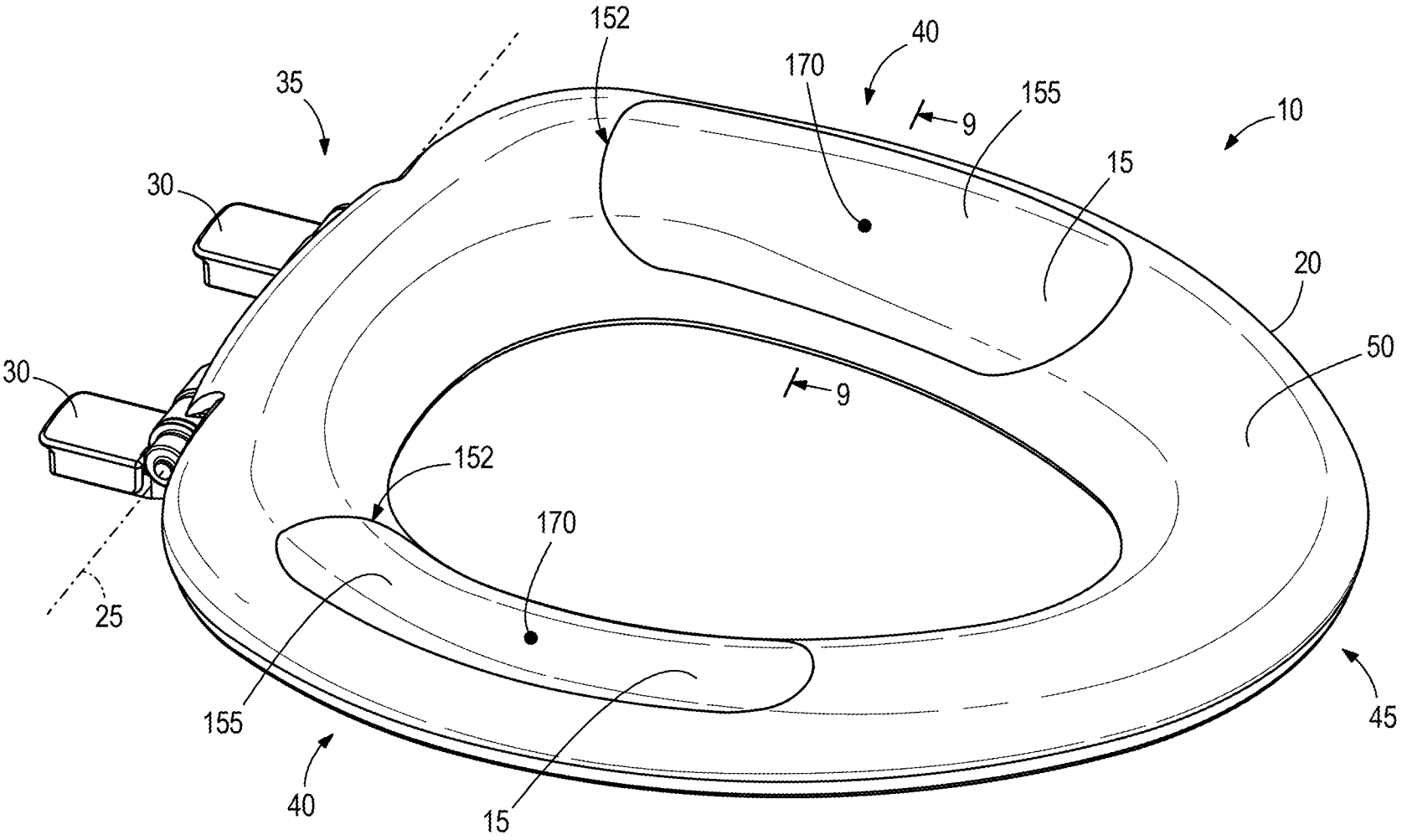
FIG. 1 is a perspective view of a toilet seat according to one embodiment of the disclosure, the toilet seat including a toilet seat frame and flexible support members coupled to the toilet seat frame.
Figure 2:
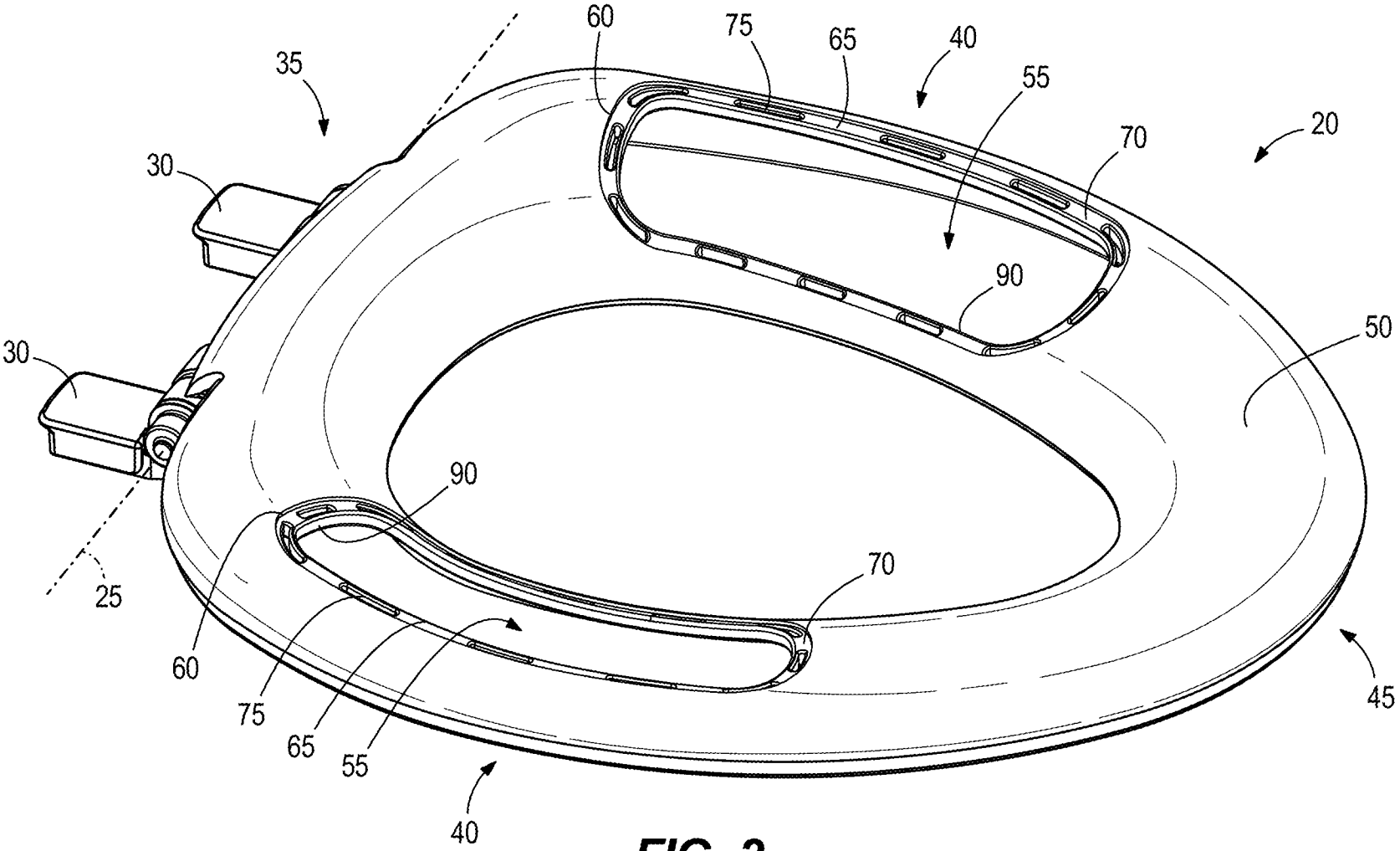
FIG. 2 is a top perspective view of the toilet seat frame of FIG. 1.

FIG. 1 illustrates a comfort toilet seat assembly 10 including flexible support members 15 coupled to a toilet seat frame 20. The comfort toilet seat assembly 10 is pivotably coupled to a toilet bowl about an axis 25 by at least one hinge post. In the illustrated embodiment, the toilet seat 10 includes two hinge posts 30. As shown in FIG. 2, the toilet seat frame 20 includes a rear portion 35 coupled to the hinge posts 30, two side portions 40 extending forward from the rear portion 35, a front portion 45 coupling the two side portions 40, and a top support surface 50 defined by the portions 35, 40, 45. The top support surface 50 is operable to at least partially support a user above the toilet. In other embodiments, the front portion 45 can be omitted such that a gap is formed between the two side portions 40 adjacent a front end of the toilet seat frame 20.

With reference to FIG. 2, the illustrated toilet seat frame 20 includes two opposing apertures 55 formed through the top support surface 50 of the side portions 40. The apertures 55 are generally located in areas where a user would contact the toilet seat frame 20 during use with the most force or pressure (e.g., under a user's hip bones). Each aperture 55 is defined by an edge 60 of the top support surface 50 with a mounting flange 65 formed inwardly from the edge 60. Each mounting flange 65 includes a top surface 70 spaced below (e.g., recessed below) the top support surface 50 of the toilet seat frame 20. In other embodiments, the top surface 70 of each flange 65 can be substantially flush with the top support surface 50 of the toilet seat frame 20. In addition, each flange 65 includes slots 75 formed through the flange 65 and are spaced around the corresponding aperture 55. In other embodiments, the toilet seat frame 20 may include fewer or more apertures 55. For example, the illustrated apertures 55 may be connected to form a single continuous aperture. Additionally or alternatively, other apertures 55 may be formed elsewhere on the toilet seat frame 20. In further embodiments, the slots 75 can be a series of apertures, oblong apertures, circular apertures, cuboid apertures, etc.

Figure 3:
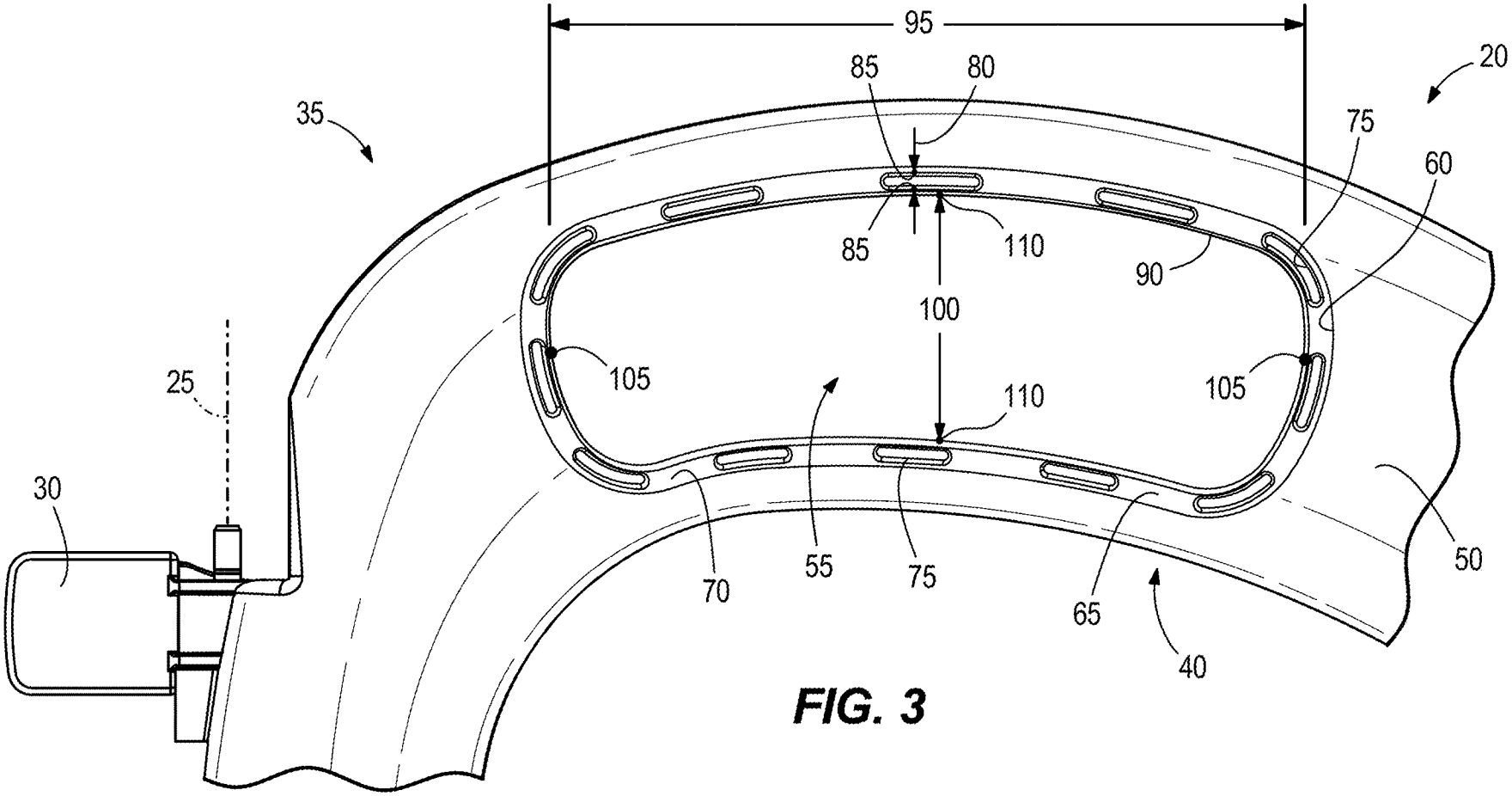
FIG. 3 is a top view of a portion of the toilet seat frame of FIG. 2.

With reference to FIG. 3, each mounting flange 65 is generally oblong-shaped and includes a generally constant circumferential width 80. The width 80 is measured perpendicular to the edge 60 between points 85 on the edge 60 and an inner edge 90 of the top surface 70. In some embodiments, the inner edges 90 can define the apertures 55. In the illustrated embodiment, the width 80 is also measured parallel to the axis 25. Each aperture 55 is also generally oblong-shaped and includes a maximum length 95 that is greater than a central width 100 of the aperture 55, which is perpendicular to the maximum length 95. The maximum length 95 is measured perpendicular to the axis 25 between points 105 on the edge 60. The central width 100 is measured perpendicular to the edge 60 between points 110 on the edge 60. In the illustrated embodiment, the central width 100 is also measured parallel to the axis 25. The maximum length 95 and the central width 100 of each aperture 55 are greater than the width 80 of each flange 65. In addition, an area of each flange 65 defined by the top surface 70 is less than an area of each aperture 55 defined within the edge 60.

Figure 4:
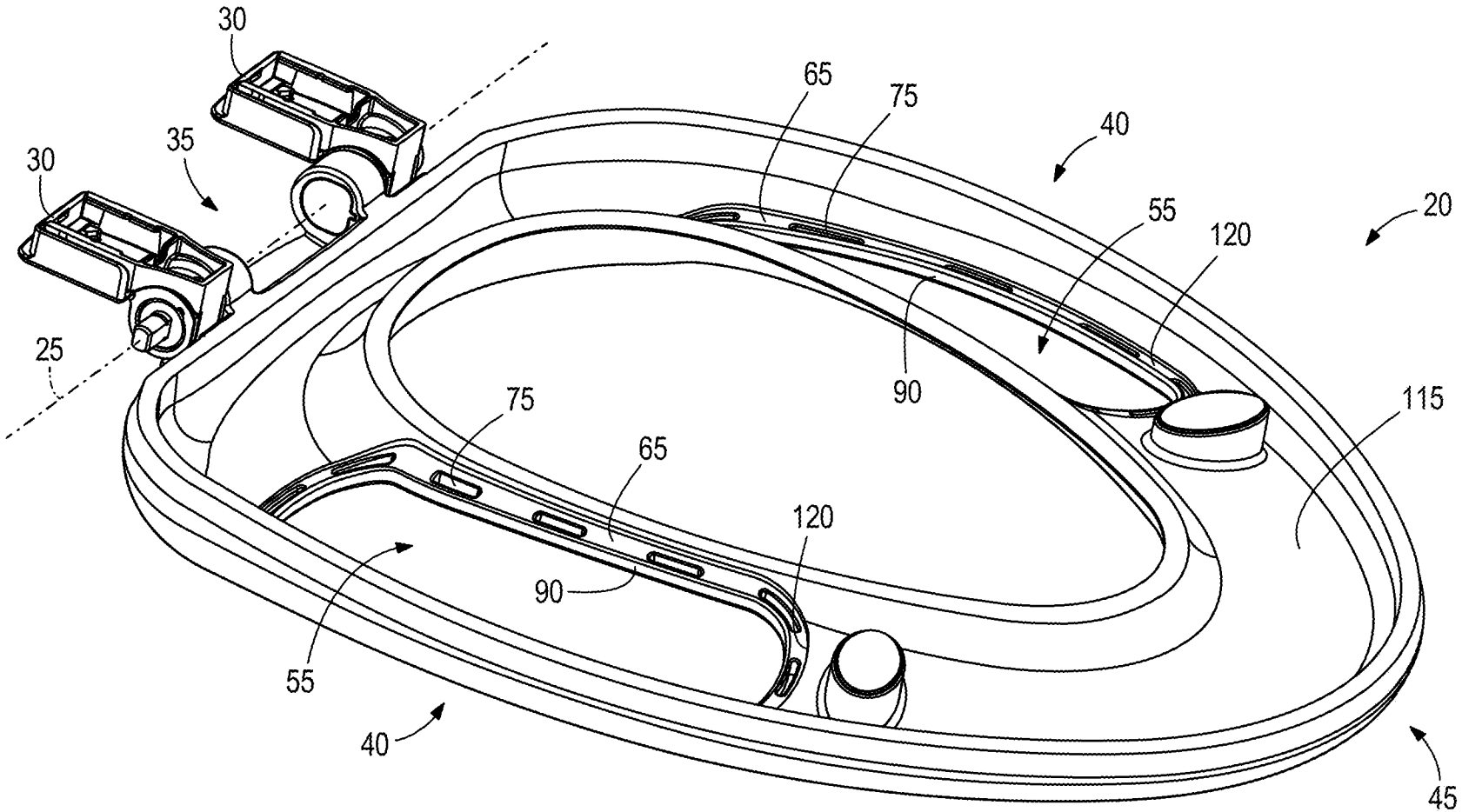
FIG. 4 is a bottom perspective view of the toilet seat frame of FIG. 2.
Figure 5:
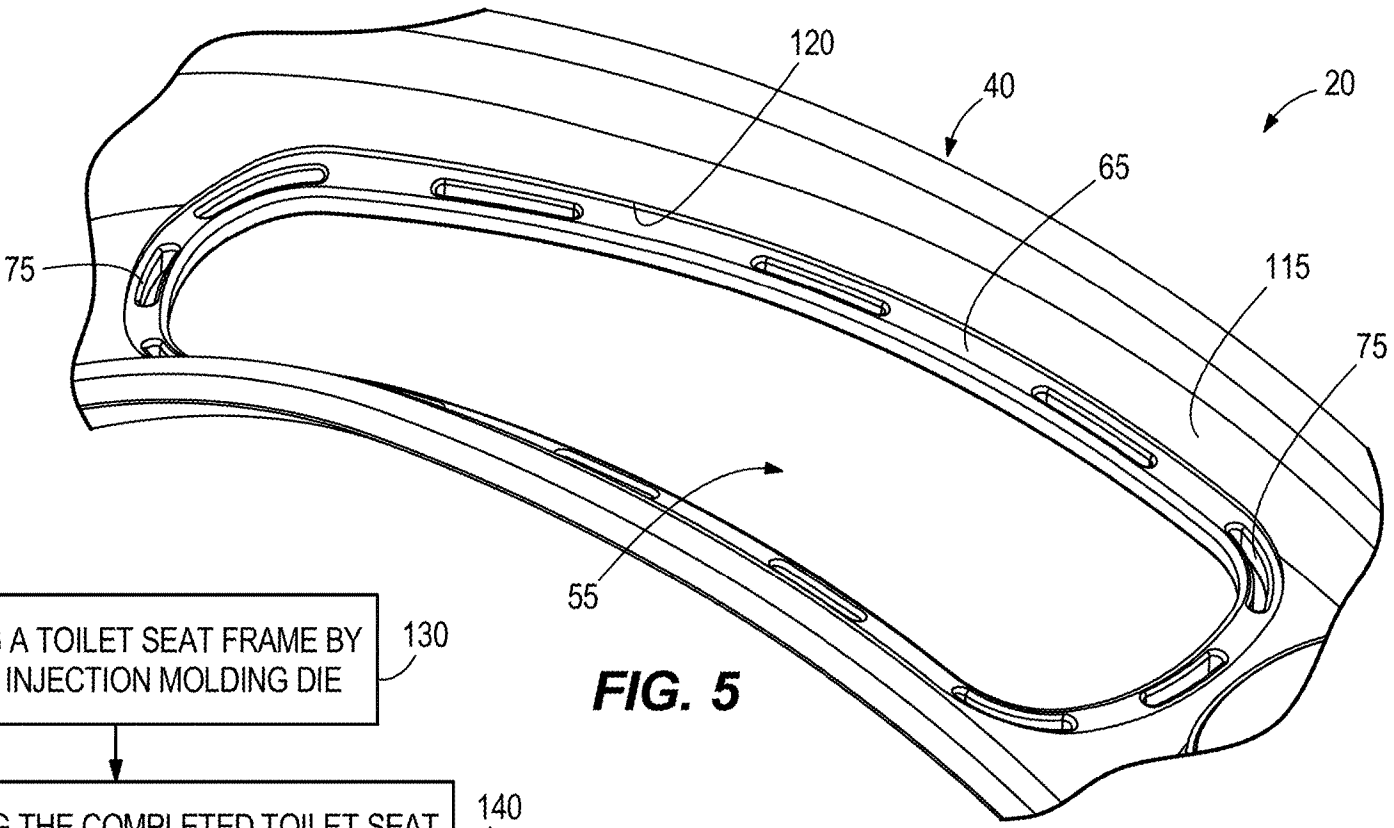
FIG. 5 is a detailed view of a bottom portion of the toilet seat frame of FIG. 4.

With reference to FIGS. 4 and 5, the apertures 55 are also formed through a bottom surface 115 of the toilet seat frame 20. Both flanges 65 are recessed above the bottom surface 115 such that an edge 120 is formed around each flange 65 (FIG. 5 illustrates one edge 120). As the flanges 65 are recessed from the top and bottom surfaces 50, 115, a thickness of each flange 65 is less than a thickness of the side portions 40 of the toilet seat frame 20. In other embodiments, the flanges 65 can be substantially flush with the bottom surface 115 of the toilet seat frame 20.

Figure 6:
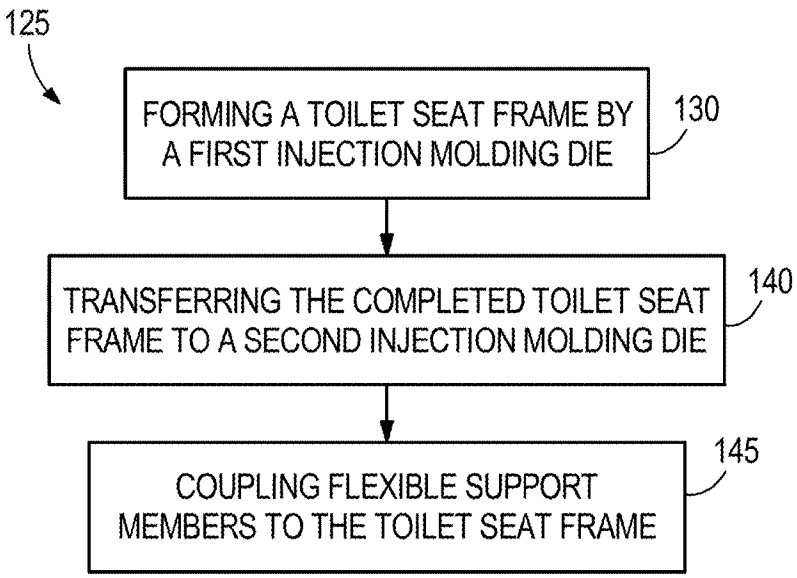
FIG. 6 is a flowchart of a method of manufacturing the toilet seat of FIG. 1.

FIG. 6 illustrates a method 125 of manufacturing the comfort toilet seat assembly 10. The method 125 includes a step 130 to form the toilet seat frame 20. In the illustrated embodiment, the toilet seat frame 20 is formed by injection molding a first polymer within a first die. The first die can be similar to a conventional die that forms a conventional toilet seat, but including features/contours that are operable to form the edges 60, 120, the flanges 65, the slots 75, and the apertures 55 during the first injection molding step 130. As the first die is operable to form the toilet seat frame 20, the first die includes a profile greater than a profile of the toilet seat frame 20. In addition, the first polymer has a first rigidity or hardness (when hardened/set after the first injection molding process) and can be, for example, polypropylene or the like. In other embodiments, the toilet seat frame 20 can be formed by a transfer molding process, cast urethane molding process, or the like. In further embodiments, the toilet seat frame 20 can be molded from the first injection molding step 130 excluding the edges 60, 120, the flanges 65, the slots 75, and the apertures 55 for a subsequent machining process (e.g., cutting, punching, stamping, etc.) to form the edges 60, 120, the flanges 65, the slots 75, and the apertures 55.

Figure 7:
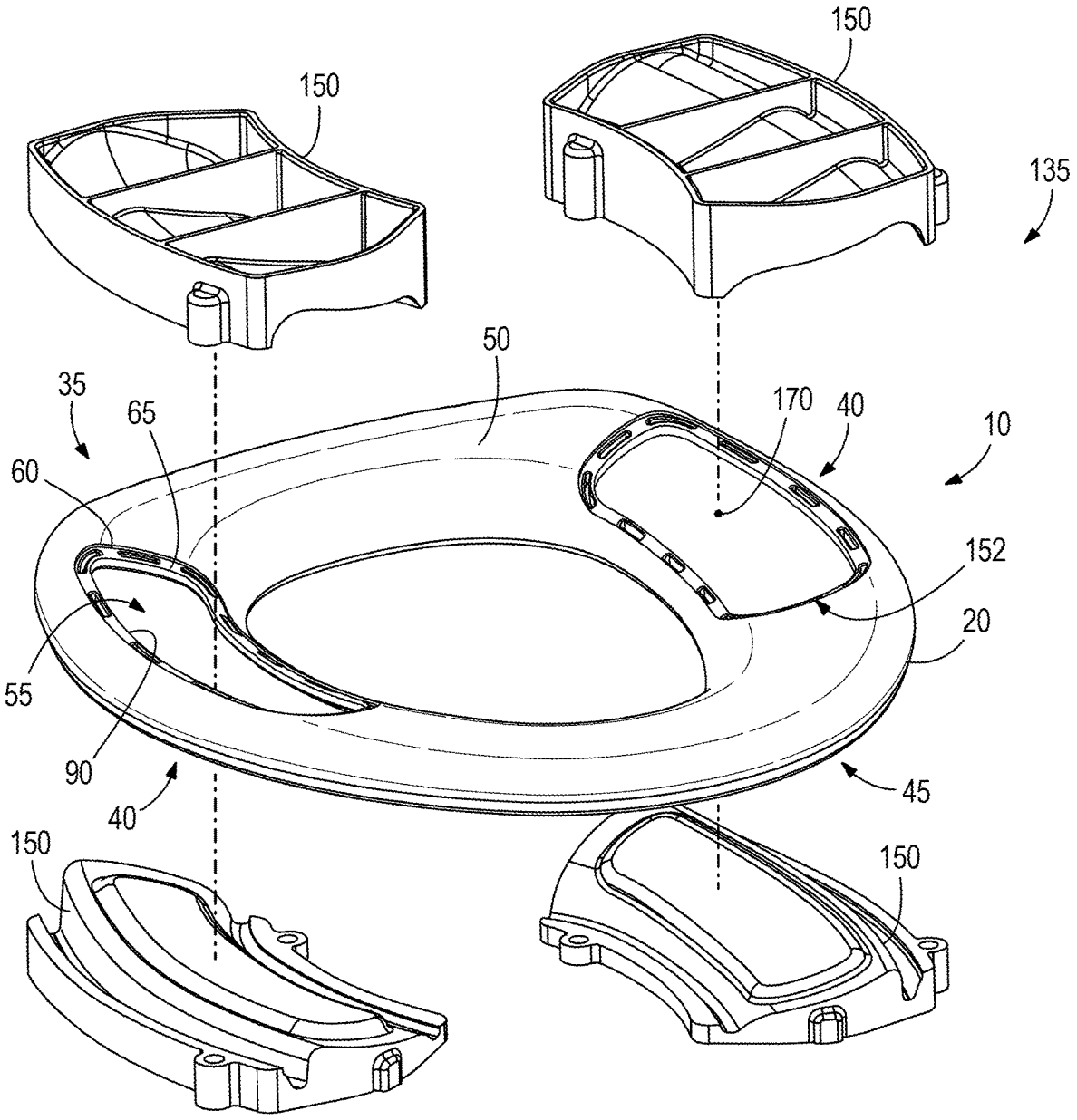
FIG. 7 is an exploded view of an injection molding die set operable to form the flexible support members of the toilet seat.

The completed toilet seat frame 20 is then transferred to a second die 135 of a second injection molding process (step 140, FIG. 7). The second die 135 clamps onto the toilet seat frame 20 for a second polymer to be injected into the second die 135 to couple the flexible support members 15 to the toilet seat frame 20 (step 145). In the illustrated embodiment, the flexible support members 15 are coupled to the toilet seat frame 20 as the flexible support members 15 are formed. In particular, the second die 135 includes two pairs of die halves or portions 150 with each pair 150 associated with one flexible support member 15. Each pair of die halves 150 includes a profile greater than a profile of the corresponding flexible support member 15, but includes a smaller profile than the profile of the toilet seat frame 20. Once the second die 135 is coupled to the toilet seat frame 20, a second polymer that is different than the first polymer is injected into the second die 135 to form the flexible support members 15. The second polymer has a second rigidity or hardness (when hardened/set after the second injection molding process) that is less than the first hardness of the first polymer and can be, for example, rubber or the like. In other embodiments, the first die used in step 130 as described above can be also used to form the flexible support members 15 such that the toilet seat frame 20 does not need to be transported to a second die. For example, the toilet seat frame 20 remains in the first die, and the first die is modified (e.g., movable sections of the first die are interchanged) to provide a cavity area for the second injection molding process to form the flexible support members 15.

Figure 8:
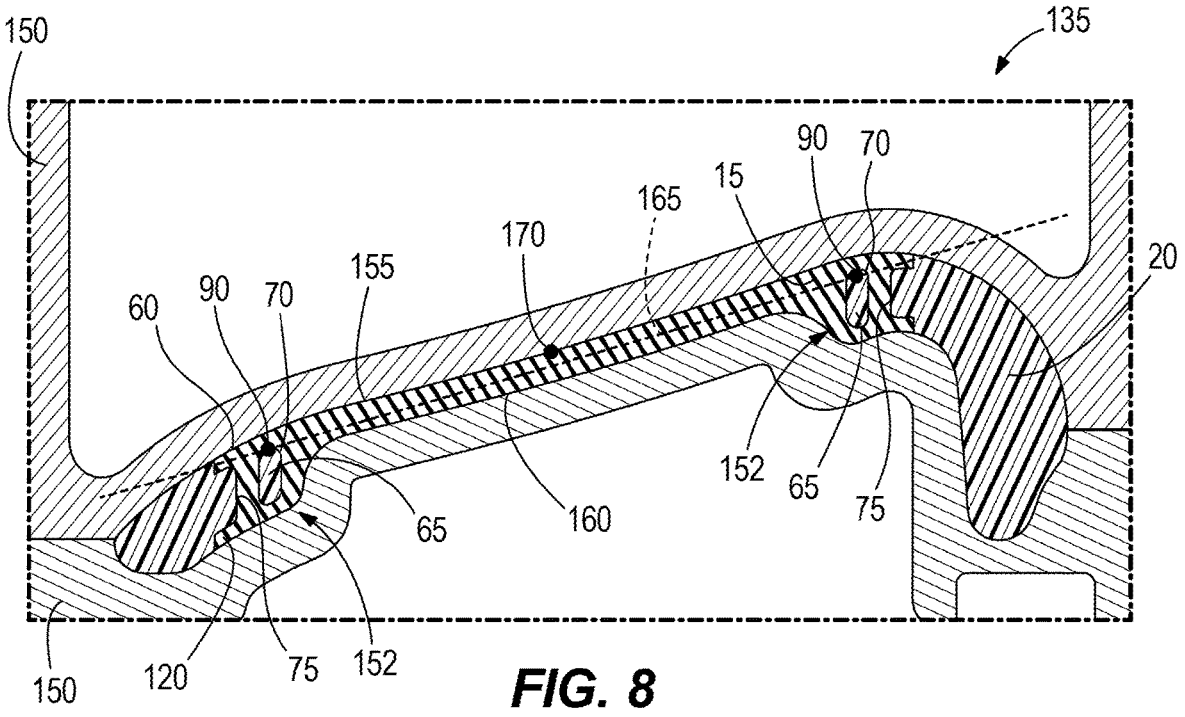
FIG. 8 is a cross-sectional view of the injection molding die set coupled to the toilet seat.

During the second injection molding process 145, the second polymer is pushed into the slots 75 (FIG. 8)—and ultimately encapsulates the flanges 65 and the slots 75—to form an outer rim 152 of each flexible support member 15 that bonds the flexible support members 15 to the toilet seat frame 20. For example, the flexible support members 15 may be made of a material that has a natural adhesion to the material of the toilet seat frame 20 when injection molded. As such, no additional step is needed to couple the flexible support members 15 to the toilet seat frame 20 (e.g., an adhesive is not needed to bond the flexible support members 15 to the toilet seat frame 20). The flexible support members 15 may be formed as solid members that extend across the apertures 55. Alternatively, the flexible support members 15 may have apertures, perforations, and/or surface texturing. These features may help achieve a desired flexibility of the flexible support members 15. These features may also visually differentiate the flexible support members 15 from the toilet seat frame 20. For example, the flexible support members 15 may have a different color than the toilet seat frame 20.

In the illustrated embodiment, the outer rims 152 of the flexible support members 15 abut the edges 60, 120 of the toilet seat frame 20 such that a top support surface 155 of each flexible support member 15 adjacent the flange 65 is substantially flush with the top support surface 50 of the toilet seat frame 20 to present a generally smooth, continuous surface. In addition, the flexible support members 15 are thinner than the toilet seat frame 20 such that a bottom surface 160 of each flexible support member 15 is higher than the bottom surface 115 of the toilet seat frame 20. Portions of the bottom surface 160 adjacent the flanges 65 are substantially flush with the bottom surface 115 where the outer rims 152 wrap around the flanges 65. Alternatively, the flexible support members 15 may have generally the same thickness as the toilet seat frame 20. In other embodiments, the flexible support members 15 can overlap with the top support surface 50 and/or the bottom surface 115 of the toilet seat frame 20. For example, the flanges 65 can be omitted or positioned substantially flush with at least one surface 50, 115 of the toilet seat frame 20 such that the outer rims 152 overlap with at least one of the top support surface 50 and the bottom surface 115 to couple the flexible support members 15 to the toilet seat frame 20. In further embodiments, the flexible support members 15 can be formed by a transfer molding process, cast urethane molding process, or the like.

In yet further embodiments, the flexible support members 15 can be inserts that are first formed (e.g., by an injection molding process) and then coupled to the toilet seat frame 20 in a subsequent step. For example, each flexible support insert 15 can include a rigid frame as the outer rim 152 that is inserted into the apertures 55 and attached to the toilet seat frame 20/flanges 65 (e.g., by adhesive, snap fit connection, etc.). Alternatively, the flexible support inserts 15 can be formed with bulbous projections that may be pushed through the slots 75 to secure the flexible support inserts 15 in place.

Figure 9:
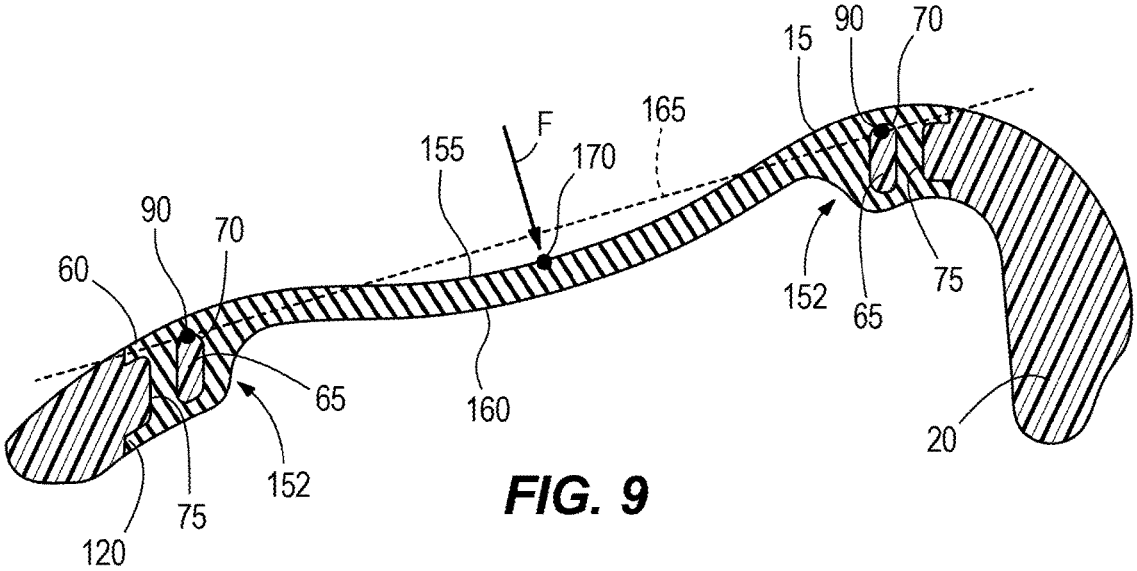
FIG. 9 is a cross-sectional view of the toilet seat taken along line 9-9 of FIG. 1 illustrating the toilet seat in use.

The outer rims 152 of the flexible support members 15 are coupled to the flanges 65 such that the flexible support members 15 are resiliently suspended across the apertures 55. Before use, the top support surface 155 of each flexible support member 15 is resiliently positioned above a line 165, which is positioned within a plane perpendicular to the length 95 of each aperture 55. The line 165 extends between two opposing points on the edge 90 of the top surface 70. As a user sits on the toilet seat assembly 10, his/her weight is distributed between the top surfaces 50, 155 of the toilet seat frame 20 and the flexible support members 15. Under enough force F (e.g., weight of the user), the flexible support members 15 deflect (e.g., stretch) such that a center point 170 of the top surface 155 of each flexible support member 15 is positioned below the corresponding line 165 (FIG. 9). In particular, the toilet seat assembly 10 is constructed such that no portion of the toilet seat frame 20 is directly below the center point 170 of each flexible support member 15, and as a result, the flexible support members 15 increase in tension as the force F is applied to the flexible support members 15. Accordingly, each flexible support member 15 functions as a freely flexible diaphragm that supports at least a portion of the user's weight to increase the comfort of using the toilet seat assembly 10 than conventional toilet seats.

In some embodiments, the flexible support members 15 may be made of other suitable materials to function as freely flexible diaphragms. For example, rather than being an injection molded polymer, the flexible support members 15 may be made of relatively thin polymer sheets using other methods. Alternatively, the flexible support members 15 may be fabric materials or foam materials that are positioned over the apertures 55. In such embodiments, the materials may be coated or covered with a polymeric-type material that is easily cleaned.

Although the disclosure has been described in detail with reference to certain preferred embodiments, variations and modifications exist within the scope and spirit of one or more independent aspects of the disclosure as described. Various features and advantages of the disclosure are set forth in the following claims.

The invention claimed is:

1. A toilet seat comprising:

a toilet seat frame including a first support surface and an edge defining an aperture extending through the toilet seat frame, the first support surface configured to at least partially support a user on the toilet seat; and a flexible support member including an outer rim coupled to the edge of the toilet seat frame such that the flexible support member is freely suspended across the aperture of the toilet seat frame, the flexible support member including a second support surface configured to at least partially support the user on the toilet seat.

2. The toilet seat of claim 1, wherein the toilet seat frame includes a flange extending inwardly from the edge such that the flange is positioned within the aperture, and wherein the outer rim of the flexible support member is coupled to the flange.

3. The toilet seat of claim 2, wherein the flange includes a plurality of slots, and wherein portions of the outer rim are positioned within the plurality of slots.

4. The toilet seat of claim 2, wherein the aperture and the flange are oblong in shape.

5. The toilet seat of claim 2, wherein the flexible support member is configured such that when a force is applied to the second support surface, a portion of the second support surface moves below a line that extends through opposing points on an upper edge of the flange.

6. The toilet seat of claim 5, wherein the flexible support member is configured to stretch as the force is applied to the second support surface.

7. The toilet seat of claim 1, wherein the edge is a first edge, the aperture is a first aperture, and the flexible support member is a first flexible support member, wherein the toilet seat frame includes a second edge defining a second aperture extending through the toilet seat frame, and wherein the toilet seat further comprises a second flexible support member including an outer rim coupled to the second edge of the toilet seat frame such that the second flexible support member is suspended across the second aperture of the toilet seat frame.

8. A method of manufacturing a toilet seat, the method comprising:

forming a toilet seat frame including a first support surface and an aperture extending through the first support surface, the first support surface configured to at least partially support a user on the toilet seat; and coupling an outer rim of a flexible support member to an edge of the toilet seat frame defining the aperture such that the flexible support member is freely suspended across the aperture of the toilet seat frame, the flexible support member including a second support surface configured to at least partially support the user on the toilet seat.

9. The method of claim 8, wherein forming the toilet seat frame includes injecting a first material into a first die to form the first support surface and the aperture.

10. The method of claim 9, further comprising transferring the toilet seat frame from the first die to a second die.

11. The method of claim 10, wherein coupling the outer rim of the flexible support member to the edge of the toilet seat frame includes injecting a second material into the second die to form the flexible support member.

12. The method of claim 11, wherein the first material has a greater hardness than the second material once the first and second materials are set.

13. The method of claim 9, wherein coupling the outer rim of the flexible support member to the edge of the toilet seat frame includes modifying the first die and then injecting a second material into the modified first die to form the flexible support member.

14. The method of claim 8, wherein forming the toilet seat frame includes forming a flange that extends inwardly from the edge such that the flange is positioned within the aperture, and wherein coupling the outer rim of the flexible support member to the edge of the toilet seat frame includes coupling the outer rim to the flange.

15. The method of claim 14, wherein forming the toilet seat frame includes forming a plurality of slots extending through the flange, and wherein coupling the outer rim of the flexible support member to the edge of the toilet frame includes positioning portions of the outer rim within the plurality of slots.

16. A toilet seat comprising:

a toilet seat frame including a first support surface, an aperture extending through the toilet seat frame, and a flange positioned within the aperture, the first support surface configured to at least partially support a user on the toilet seat; and a flexible support member coupled to the flange and extending across the aperture, the flexible support member including a second support surface configured to at least partially support the user on the toilet seat, wherein the flexible support member is configured such that when a force is applied to the second support surface, a portion of the second support surface moves below a line that extends through opposing points on an upper edge of the flange.

17. The toilet seat of claim 16, wherein the flexible support member is configured to stretch as the force is applied to the second support surface.

18. The toilet seat of claim 16, wherein the flange includes a plurality of slots, and wherein portions of the flexible support member is positioned within the plurality of slots.

19. The toilet seat of claim 18, wherein the flexible support member includes an outer rim coupled to an edge of the toilet seat frame defining the aperture such that the flexible support member is suspended across the aperture of the toilet seat frame.

20. The toilet seat of claim 19, wherein the aperture and the flange are oblong in shape.

* * * * *